US006949715B2

(12) United States Patent
Kelly

(10) Patent No.: US 6,949,715 B2
(45) Date of Patent: Sep. 27, 2005

(54) METHOD AND APPARATUS FOR PARTICLE SIZE SEPARATION

(76) Inventor: Arnold J. Kelly, 8 Hathaway Dr., Princeton Junction, NJ (US) 08550

( * ) Notice: Subject to any disclaimer, the term of this patent is extended or adjusted under 35 U.S.C. 154(b) by 18 days.

(21) Appl. No.: 10/360,694

(22) Filed: Feb. 7, 2003

(65) Prior Publication Data

US 2003/0192815 A1 Oct. 16, 2003

Related U.S. Application Data

(60) Provisional application No. 60/355,069, filed on Feb. 8, 2002.

(51) Int. Cl.[7] ..... B03C 7/00
(52) U.S. Cl. ..... 209/127.1
(58) Field of Search ..... 209/127.1, 127.3, 209/129, 147, 149, 906; 96/27

(56) References Cited

U.S. PATENT DOCUMENTS 3,308,944 A * 3/1967 Chamberlain et al. ..... 209/3
3,413,545 A * 11/1968 Whitby ..... 324/71.1
3,520,172 A * 7/1970 Liu et al. ..... 73/28.04
3,853,750 A * 12/1974 Volsy ..... 209/127.1
4,255,777 A * 3/1981 Kelly ..... 361/228
4,588,423 A * 5/1986 Gillingham et al. ..... 96/43
4,895,642 A * 1/1990 Frei ..... 209/127.3
5,378,957 A * 1/1995 Kelly ..... 313/231.01
6,323,451 B1 * 11/2001 Stencel et al. ..... 209/127.1
6,415,929 B1 * 7/2002 Maehata et al. ..... 209/12.2
6,651,818 B1 * 11/2003 Ilmasti et al. ..... 209/12.2

* cited by examiner

*Primary Examiner*—Donald P. Walsh
*Assistant Examiner*—Joseph Rodriguez
(74) *Attorney, Agent, or Firm*—Lerner, David, Littenberg, Krumholz & Mentlik, LLP

(57) ABSTRACT

An apparatus for separating a stream of particles comprises a charging device for injecting a net charge into a plurality of particles and a collector adjacent the charging device. The collector is grounded and arranged so that the charged particles disperse and collect on the collector according to a characteristic of the particle, such as size. A method of separating a stream of particles is also disclosed.

18 Claims, 12 Drawing Sheets

METHOD AND APPARATUS FOR PARTICLE SIZE SEPARATION

CROSS-REFERENCE TO RELATED APPLICATIONS

The present application claims the benefit of U.S. provisional application No. 60/355,069, filed Feb. 8, 2002, the disclosure of which is hereby incorporated by reference herein.

FIELD OF THE INVENTION

The present invention relates to methods and apparatus for separation, filtration or sorting of powders or other particles.

BACKGROUND OF THE INVENTION

Manufacturing processes for pharmaceuticals, coatings, paints, and other products involve the manipulation of powdered substances or other small particles. Certain processes require particles of a certain size or size range. Materials are desirably sorted according to size in certain processes in order to achieve a desired effect. Separation and sorting of small particles is used in pharmaceutical manufacturing, coating, painting, and measuring and observing particles in environmental evaluations, and other fields.

Known methods of sorting particles have drawbacks. Known electrostatic methods have difficulty separating particles according to size and require apparatus using large currents and large amounts of power.

Further improvements to methods and apparatus for separating, filtering or sorting particles are desired.

SUMMARY OF THE INVENTION

In one aspect of the present invention, an apparatus for separating a stream of particles by size comprises a charging device for injecting a net charge into a plurality of particles and a collector adjacent the charging device, the collector being grounded and arranged so that the charged particles disperse and collect on the collector according to size. Embodiments of the present invention employ electrostatic particle charging to selectively segregate particles by size. Injecting a net charge into the particles develops a self electric field for the particles and achieves a high charge density for the particles.

As used herein, "particles" or "particulates" include dust, powder, pollen, spores, virus, bacteria, droplets, fibers and any small particles of any material.

In certain preferred embodiments, the apparatus includes a feed apparatus arranged for delivering a stream of particles to the charging device. The feed apparatus may include an aerosol feed apparatus, a vibratory feed apparatus, or both. The feed apparatus may include any apparatus known in the art for providing a stream of particles. The feed apparatus may entrain the particles in a moving fluid. The fluid may include liquids or gases, such as air, nitrogen, water, etc.

The feed apparatus is desirably disposed upstream of the charging device and moves the fluid entrained with the particles in a downstream direction. The charging device, in certain preferred embodiments, comprises an electron gun. The collector is desirably disposed downstream of the charging device.

The collector desirably comprises a body of a conductive material. The collector may comprise a collector cone, a collector plate, or at least one collector container. The collector may comprise any shape. In certain preferred embodiments, the collector comprises a collector plate bent at a fold line.

In a further aspect of the present invention, a method of separating a stream of particles by size comprises injecting a net charge into a plurality of particles including particles having different sizes so that each particle has a charge to mass ratio depending upon the size of the particle, and allowing the charged particles to disperse and collect on a collector having a conductive surface.

The charge is desirably injected by directing free electrons at the plurality of particles. In certain embodiments, the step of providing the plurality of particles comprises entraining the plurality of particles in a fluid. The method may include a step of providing the plurality of particles by moving the fluid so as to generate a stream of the particles moving in a downstream direction. The stream of particles is desirably directed at a charging device and the collector is desirably disposed downstream of the charging device.

The step of allowing the charged particles to disperse desirably includes moving the fluid, after the particles are injected with the net charge, until the particles are significantly arranged according to size.

The plurality of particles may include a first particle and a second particle and the step of allowing the charged particles to disperse may include the first particle repelling the second particle. The first particle may have a first size and the second particle may have a second size different from the first size. The force repelling the second particle may depend upon the first size and second size.

The step of allowing the particles to collect may include depositing the first particle in a first region of the collector and depositing the second particle in a second region of the collector.

In certain preferred embodiments, the charge is injected by directing a stream of the particles past a pair of electrodes located upstream of an orifice.

Passage through a charging station preferentially imparts more relative charge to smaller particles than to their larger counterparts in the stream of particles. Spatial separation of differentially charged particles occurs in the presence of an electric field. Either an external electric field or the self-field of the charged stream of particles can be used to segregate particles by size.

In certain preferred embodiments, the particles are separated under the influence of the self-field generated by the charge imparted to the particles. In such embodiments, the requirement for a separate voltage source to establish an external field can be eliminated. Further, the self-field strength can be substantially stronger than the strength provided by an exogenous source. Moreover, self-field separations involve fewer geometrical constraints, and will be amenable to scale-up in an industrial setting.

BRIEF DESCRIPTION OF THE DRAWINGS

These and other features, aspects and advantages of the present invention will become better understood with regard to the following description, appended claims, and accompanying drawings where:

DETAILED DESCRIPTION

A variety of particles can be effectively and reliably separated by size utilizing electrostatic particle charging. In a preferred embodiment, an electron gun provides a source of free electrons for charging the particles. The electron gun may comprise an electron gun as disclosed in certain embodiments of U.S. Pat. Nos. 5,378,957, and 5,093,602, the disclosures of which are hereby incorporated by reference herein. In other embodiments, the particles are charged utilizing a device disclosed in certain embodiments of U.S. Pat. No. 4,255,777, the disclosure of which is hereby incorporated by reference herein.

Any particles may be separated in embodiments of the invention, including powders, dust, powder, pollen, spores, virus, bacteria, droplets, fibers, and others. Particles of natural or man-made materials may be separated. In certain preferred embodiments, powdered pharmaceuticals are used. The ability of Theophylline powders to accept charge is inversely related to particle size. The transfer efficiency for charging, defined as the ratio of powder mass collected on a grounded target to the mass projected toward the target at fixed conditions, permits quantitative evaluation of powder charging capability.

For example, a fine Theophylline powder having a particle size distribution with a peak at 30 $\mu$m and no particles larger than 123 $\mu$m, may be reliably deposited with a transfer efficiency of 58%. In another example, a coarser powder may have a particle size distribution with a peak at 180 $\mu$m, a maximum size of 600 $\mu$m, and a markedly lower transfer efficiency of 15%. Intermediate sized powders deposit with efficiencies that scale with size. Differential charging occurs as a function of particle size.

Figure 1:
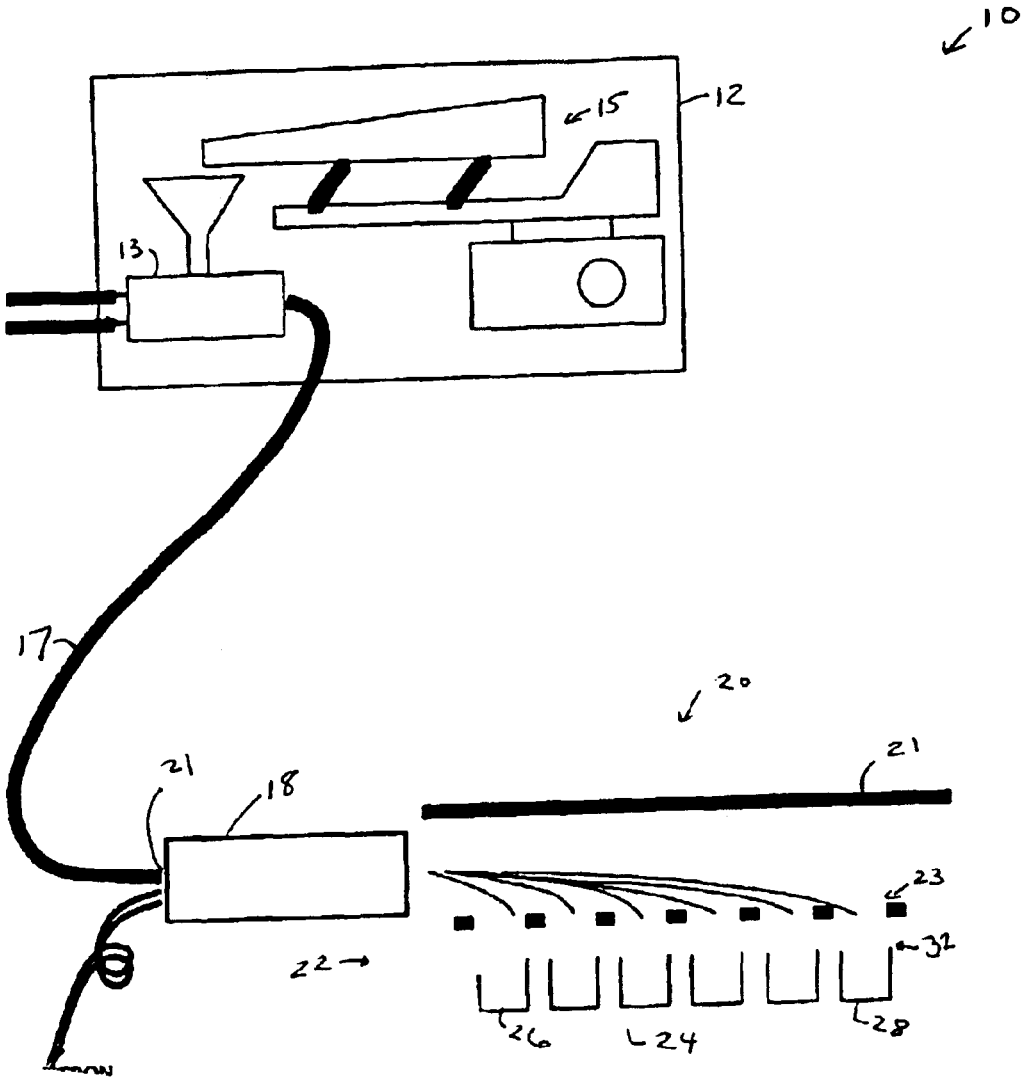
FIG. 1 is a schematic plan view of an apparatus for separating a stream of particles in accordance with an embodiment of the invention.

An apparatus according to an embodiment of the invention is shown in FIG. 1. The apparatus 10 has a feed apparatus 12 for feeding particles 14 in a stream 16 at a constant flow rate though a charging station 18. The feed apparatus 12 comprises an aerosol feed system 13 and vibratory feed system 15 for producing a stream 16 of particles 14. The aerosol feed system 13 is connected to the vibratory feed system 15. The aerosol feed system 13 has a feed tube 17 with an exit 21. The charging station 18 imparts a charge to the particles 14 in the stream 16. A separations section 20 is disposed downstream of the charging station 18. The stream 16 of charged particles 14 is directed through the separations section 20. The separations section 20 has a grounded electrode 21 and a positively charged segmented electrode 23 forming a fixed electric field gradient to physically separate the particles 14 in accordance with their charge to mass ratio and accordingly by size. The particles 14 are deposited at different positions within the separations section 20, according to the charge imparted to each of the particles and according to the particle size. The apparatus 10 desirably includes a collector 22 within the separations section 20. The particles 14 are collected within the collector 22. The sizes of the particles collected in a given area of the collector 22 may be confirmed using a phase doppler particle analyzer.

Figure 2:
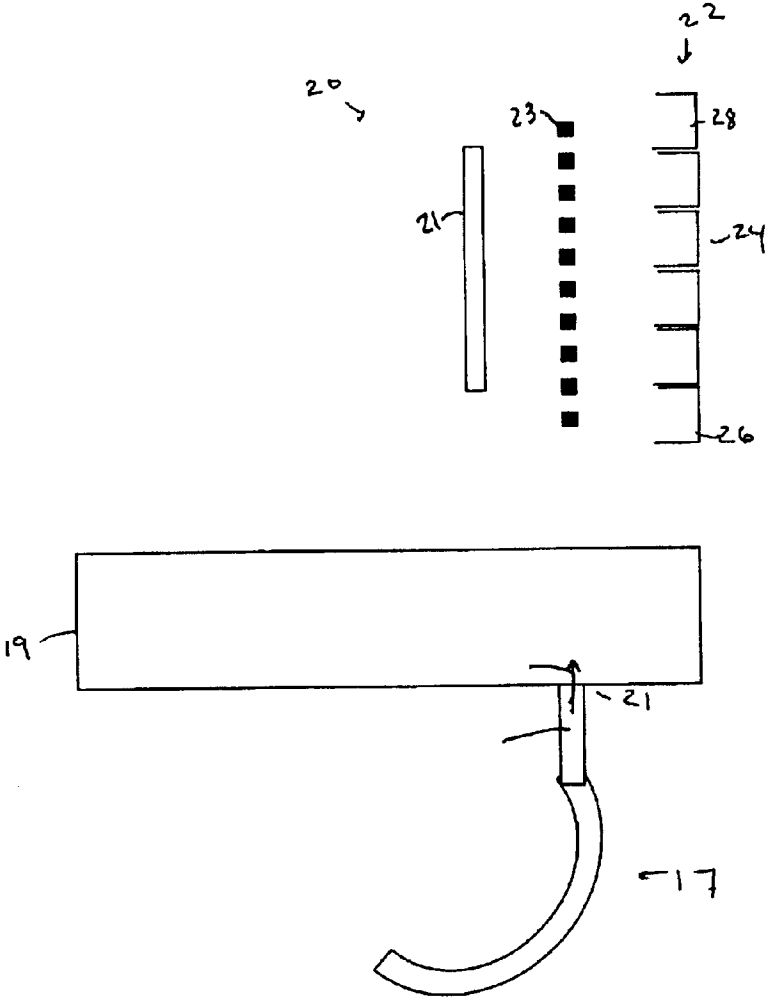
FIG. 2 is a schematic plan view of an apparatus for separating a stream of particles in accordance with the embodiment of FIG. 1.
Figure 3:
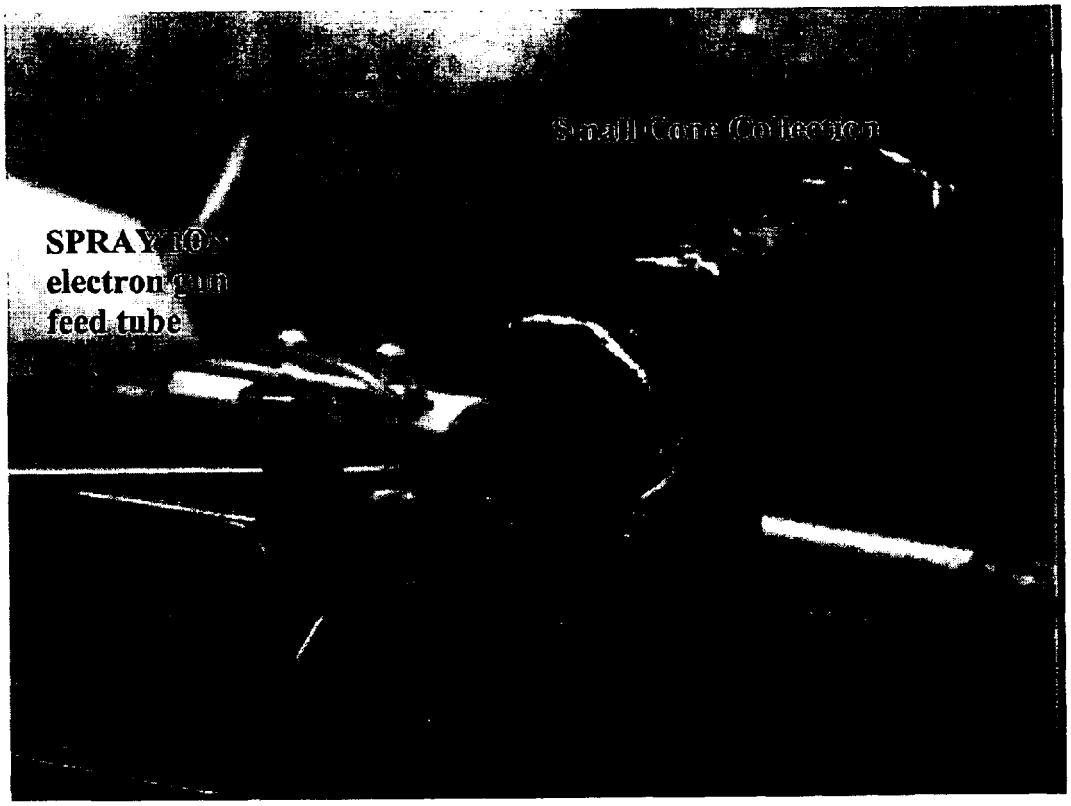
FIG. 3 is a top right perspective view of an apparatus for separating a stream of particles in accordance with a further embodiment of the invention.
Figure 4:
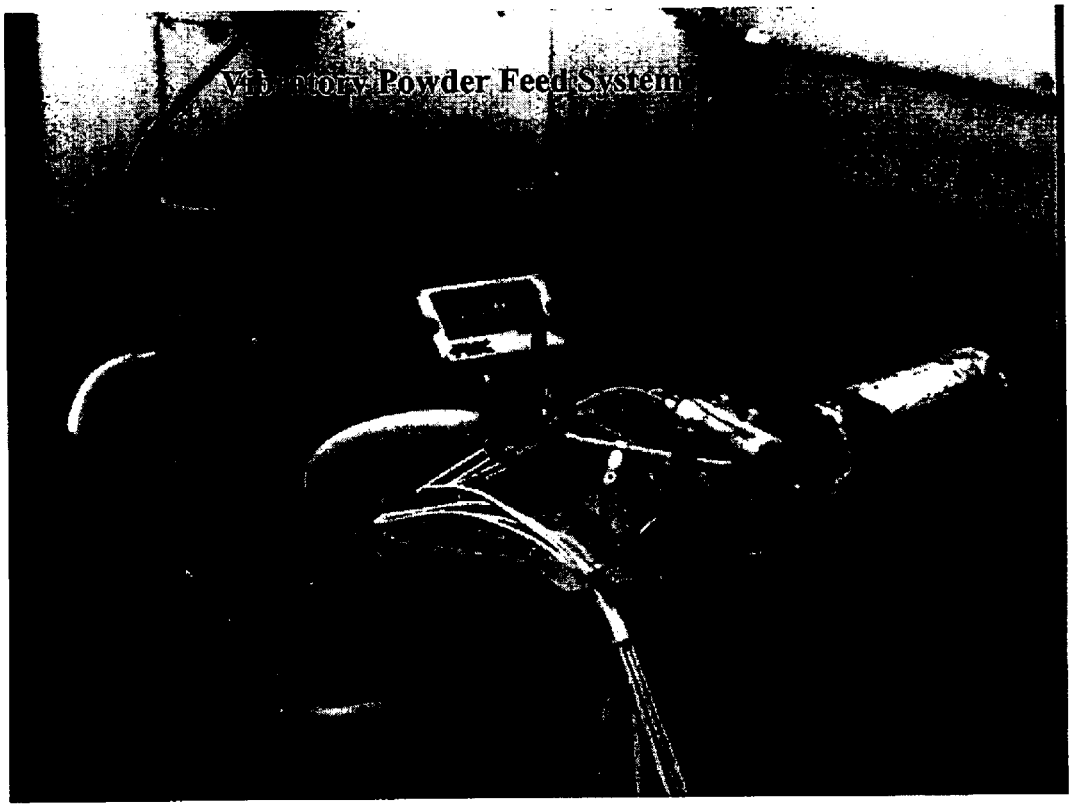
FIG. 4 is a top right perspective view of an apparatus for separating a stream of particles in accordance with the embodiment of FIG. 3.
Figure 5:
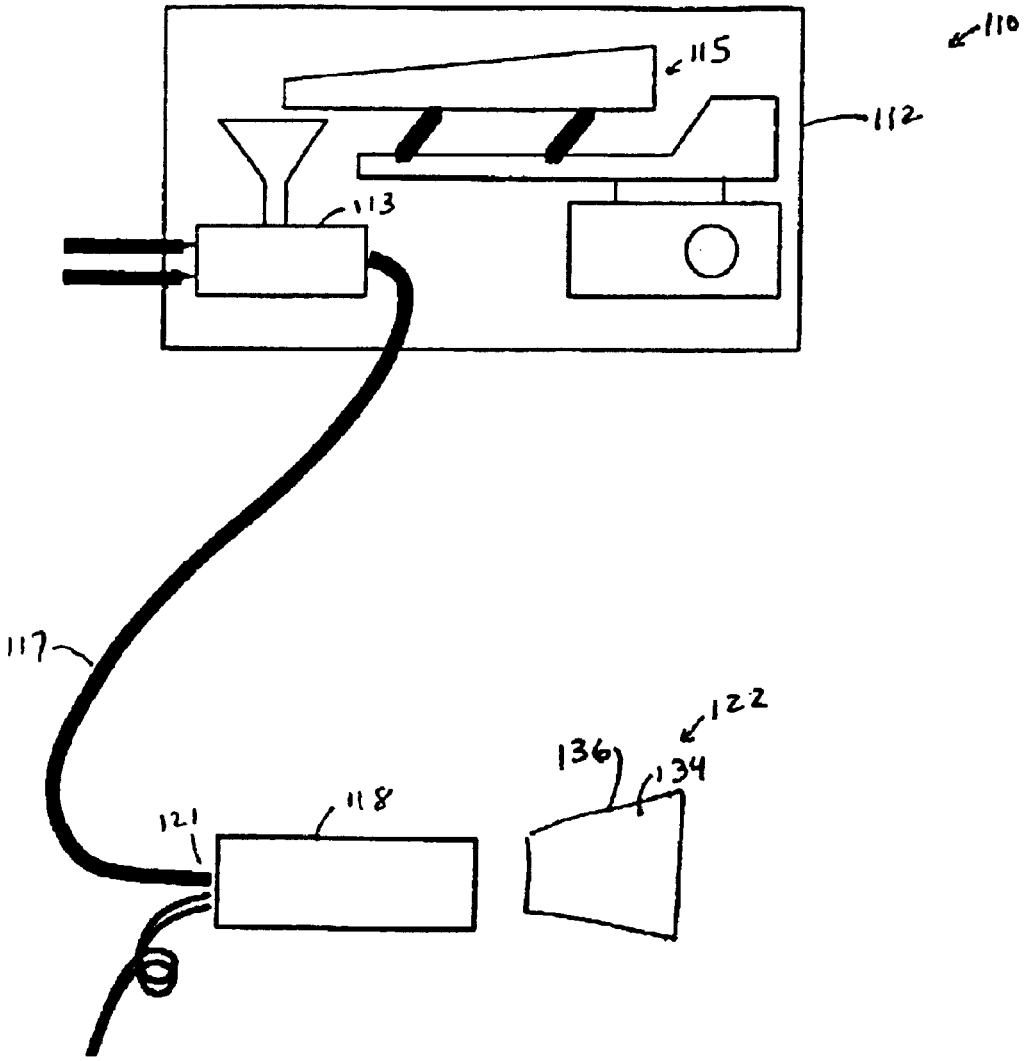
FIG. 5 is a schematic plan view of an apparatus for separating a stream of particles in accordance with the embodiment of FIGS. 3–4.
Figure 6:
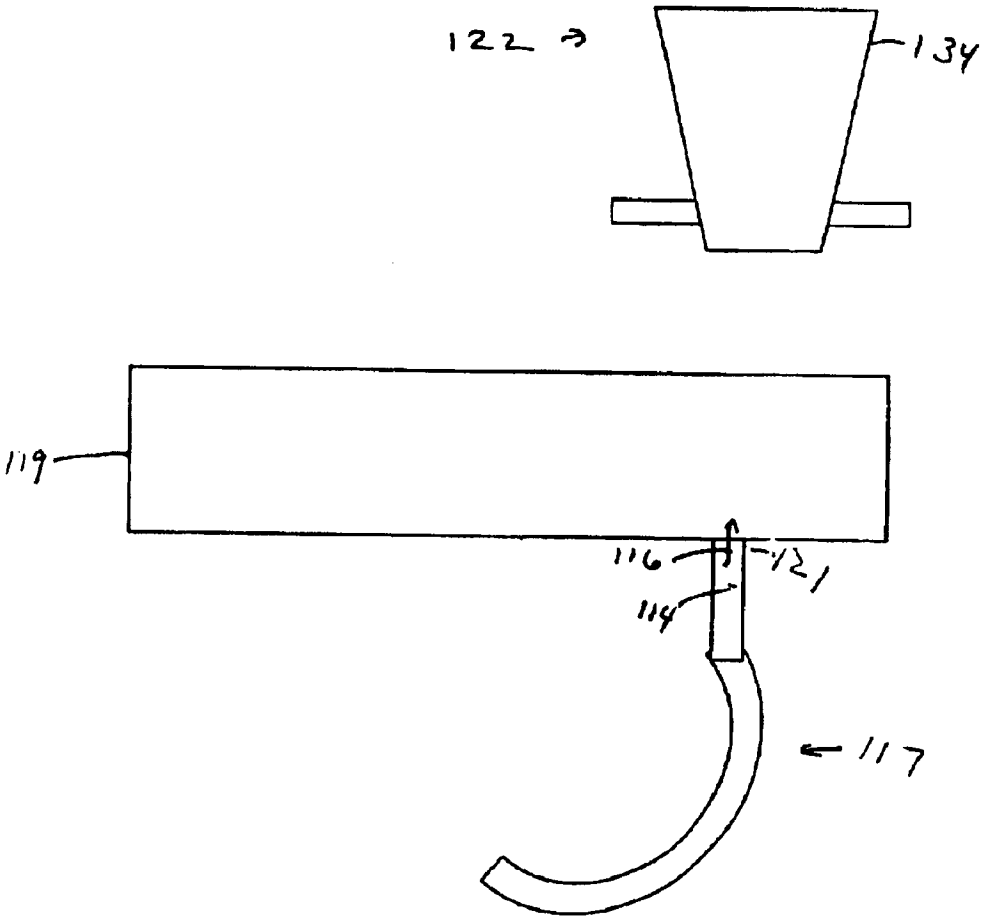
FIG. 6 is a schematic plan view of an apparatus for separating a stream of particles in accordance with the embodiment of FIGS. 3–5.

The charging station 18 has a charging device 19, which desirably comprises an electron gun but may also comprise any device for imparting a charge to the particles. The exit 21 of the feed tube 17 is connected to the charging device 19, as shown in FIG. 2.

The collector 22 comprises a body having a conductive surface and may comprise a sheet, container, enclosure or may have any other shape. The collector 22 is grounded. In the embodiment shown in FIG. 1, the collector 22 comprises a plurality of containers 24 arranged within the separations section 20. The containers 24 are arranged so that a first container 26 is closer to the charging station 18 than a second container 28. The number of containers 24 may be selected according to the range of size for the particles 14 in the stream 16, the range of sizes for the particles 14 desired to be collected in each container 24, and other factors. The size of the containers 24 should be selected to take into account the self-dispersivity of the stream 16 of charged particles 14, so that loss of particles between containers 24 is minimized. The shape of the containers 24 should be arranged to take into account any corona discharge that may occur from the edges 32 of the containers 24. Corona discharge from the edges 32 of the containers 24 limits the electric field strength driving the separations process.

The collector 22 is desirably arranged to limit the effect of the charged particles 14 on the electric field strength in the separations section 20. For particles that are relatively insulating, the particles form an insulating layer on the collector 22 that not only effectively isolates the surface of the collector 22, but accumulates charge. This "back charging" effect can detract from the efficacy of the separations process.

In a further embodiment, the electrodes 21 and 23 are eliminated and the "self-field", of the charged particle stream is relied upon to separate the particles by size.

As shown in FIGS. 3–6, the collector 122 comprises a collector cone 134. The collector cone 134 takes full advantage of the substantial self-field of the charged stream 116 of particles 114, the closed geometry of the collector surface 136 of the collector cone 124, and inherently eliminates the "back charging" effect generated by the particles 114 collected on the collector 122.

The collector cone 124 may be formed from a mandrel enclosed by aluminum foil having a thickness of about 25 μm. After collection, the conical collector may be removed and cut longitudinally along the bottom surface to expose the collected material.

In the embodiment shown in FIGS. 3–6, the feed apparatus 112 comprises a vibratory feed system 115 and aerosol feed apparatus 113 for producing a stream 116 of particles 114. The feed apparatus 112 has a feed tube 117 that has an exit 121 connected to the charging device 119 in the charging station 118. The feed apparatus 112 has an enclosure for containing the stream 116 of particles 114 within the apparatus 110. For clarity, the glove-bag enclosure surrounding the vibratory feed system 115 has been removed in FIG. 4. In a preferred embodiment, dry, filtered air is continuously infused into the enclosure of the feed apparatus 112, maintaining the humidity in a range of 20% to 40%.

EXAMPLES

Figure 7:
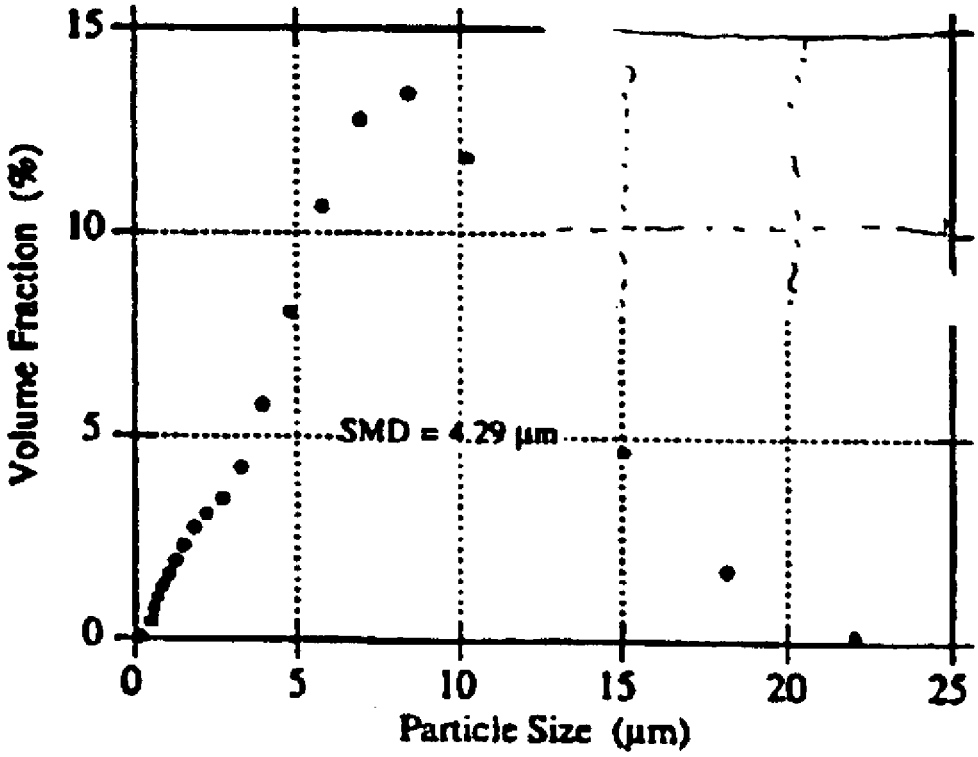
FIG. 7 is a graph of the size distribution of a sample of particles.

The apparatus shown in FIG. 1 was provided a collector cone similar to that shown in FIG. 2 and a stream of powdered pharmaceutical particles was formed using the vibratory feed system 215 and aerosol feed system 113. (See FIGS. 5 and 6). Triamcinolone Acetonide (TAA) powder was obtained from RPR/Upjohn. A particle size distribution was provided with the material and is shown in FIG. 7. The powder was sifted prior to use. The feed tube 117 had an inner diameter of 5 mm and the distance between the centerline of the feed tube 117 and the charging device 119 was 4.4 mm. The distance from the feed tube 117 exit 121 to the centerline of the charging device 119 was 4.0 mm. The charging device 119 comprised an apparatus according to certain embodiments of U.S. Pat. No. 5,378,957, the disclosure of which is hereby incorporated by reference herein.

The collector cone 124 was arranged coaxially with the feed tube 117 and had a length of 133 mm. The inlet 142 of the collector cone 124 was 64 mm in diameter and the outlet 144 of the collector cone 124 was 80 mm in diameter. The taper of the wall 146 of the collector cone 124 was 40°. The distance between the feed tube 117 exit and the collector cone 124 was 30 mm. The distance from the feed tube 117 exit 121 and the rotating target was 290 mm.

The charging device 119 comprised an electron gun having a beam accelerating voltage of −20.00 kV, a beam current of 2.5±0.5 μA, a window bias voltage of −1220±20 V, a window $N_2$ flow rate of 40 mL/s, and a cooling $N_2$ flow rate 20 mL/s. The stream of particles comprised an aerosol stream of TAA provided at a flow rate of 1 g/s. The aerosol air flow rate (A) was 15 L/min and the mixing air flow rate (F) was 10 L/min. The relative humidity of the air was 20% to 40% and the air temperature was 18 to 21° C. In other embodiments, the fluid for the aerosol comprises gases or liquids.

Operation with freely flowing powder and the charging device off produces a stream of particles. Some tribo-charging of the particulates occurs within the aerosol feed apparatus. The tribo-charged particulate current is positive and in the low nano-ampere range, while the charge imparted to the stream by the charging device 119 is negative and at the micro-ampere level. The charging from the charging device 119 completely overwhelms tribo-charging effects.

The apparatus had an overall length of only 133 mm. The collector cone 124 preferentially collected the most highly charged and therefore the smallest particles in the stream. The deposited particulates represented the small particle portion of the original TAA particle stream (which had the size distribution shown in FIG. 7.). The longer the collector cone, the greater a portion of the original stream will be collected, with the particle size distributed monotonically from the smallest diameter particulates at the entrance of the conical collector to the largest at the exit of the conical collector.

Any device for analyzing and confirming the size distribution of the particles that are deposited on a given region of may be used. A Phase Doppler Particle Analyzer by Aerometrics, Inc. in Sunnyvale, Calif. may be used for measuring particle sizes of the separated sample. Any other apparatus for measuring the particle sizes may be used.

Figure 8:
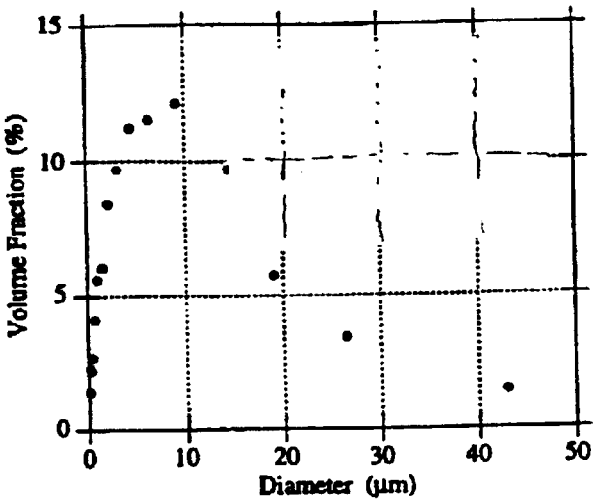
FIG. 8 is a graph of the size distribution of a control sample of the particles of FIG. 7.

Comparison of a "control sample" of unseparated particles size distribution measured (See FIG. 8) and the distribution of FIG. 7 provided with the test material were generally comparable and reflected the general characteristics of the powder tested.

Figure 9:
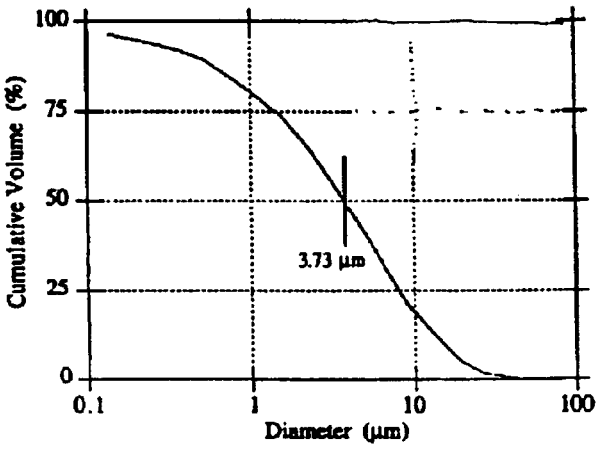
FIG. 9 is a graph of the volume percent of control sample particles in excess of a given size.

The control sample distribution was plotted in terms of the cumulative volume percent in excess of a given size (See FIG. 9). The "control n=1" distribution was seen to have 50% of the particle volume larger than 3.73 μm ($V_{50}$=3.73). Powder samples collected from the collector cone test data "Ground Small Cone Trial 1, n=2", . . . ) had $V_{50}$ values of about 4 μm, indicating that a longer collector cone should be used to provide sufficient distance for effective size separation to take place.

In a further example, the apparatus was provided with a collector comprising a collector plate 250. (See FIG. 10.) In this arrangement, the collector plate was grounded. The collector plate comprised a 10 cm (4") by 30 cm (12") plate of a conductive material. The plate was arranged so that a portion of the plate was parallel to the stream of particles, perpendicular to the centerline of the charging device 219, and 8 mm from the aperture of the charging device. In a further arrangement, a collector plate 350 comprised a flat plate, as shown in FIG. 11. In a preferred arrangement, the collector plate is bent away from the stream of particles at a fold line 344. Folding the collector surface away from the stream in this manner permits the charged particles to spatially separate over successively larger distances.

Figure 10:
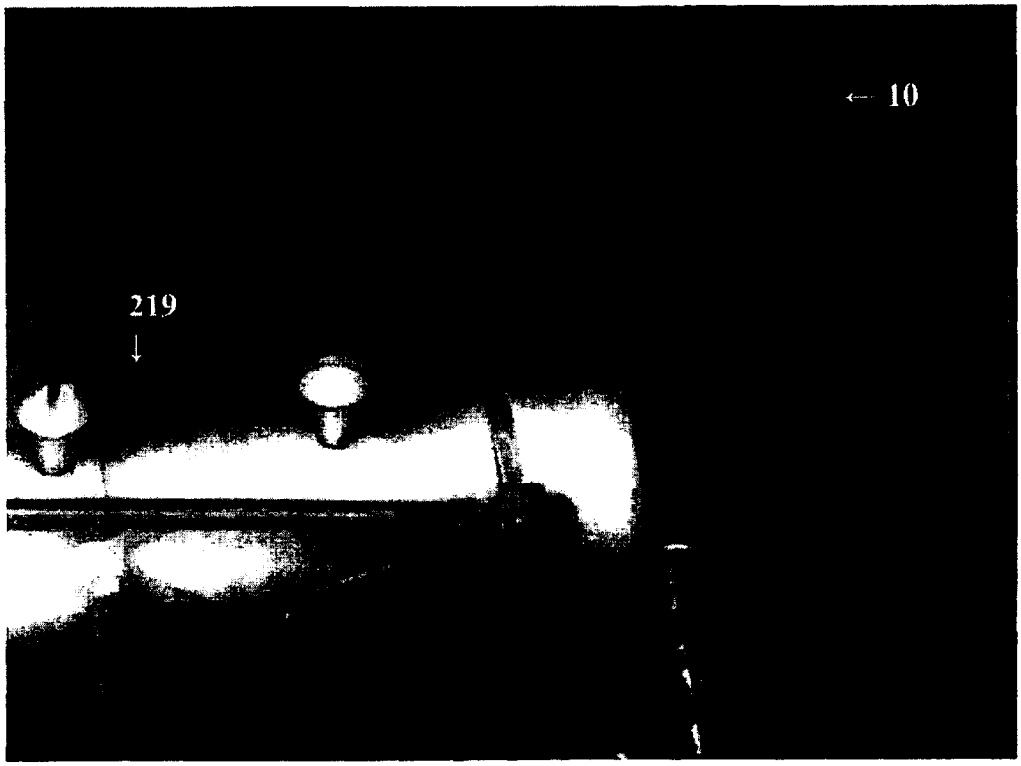
FIG. 10 is a front elevational view of a charging device and collector in accordance with a further embodiment of the invention.
Figure 11:
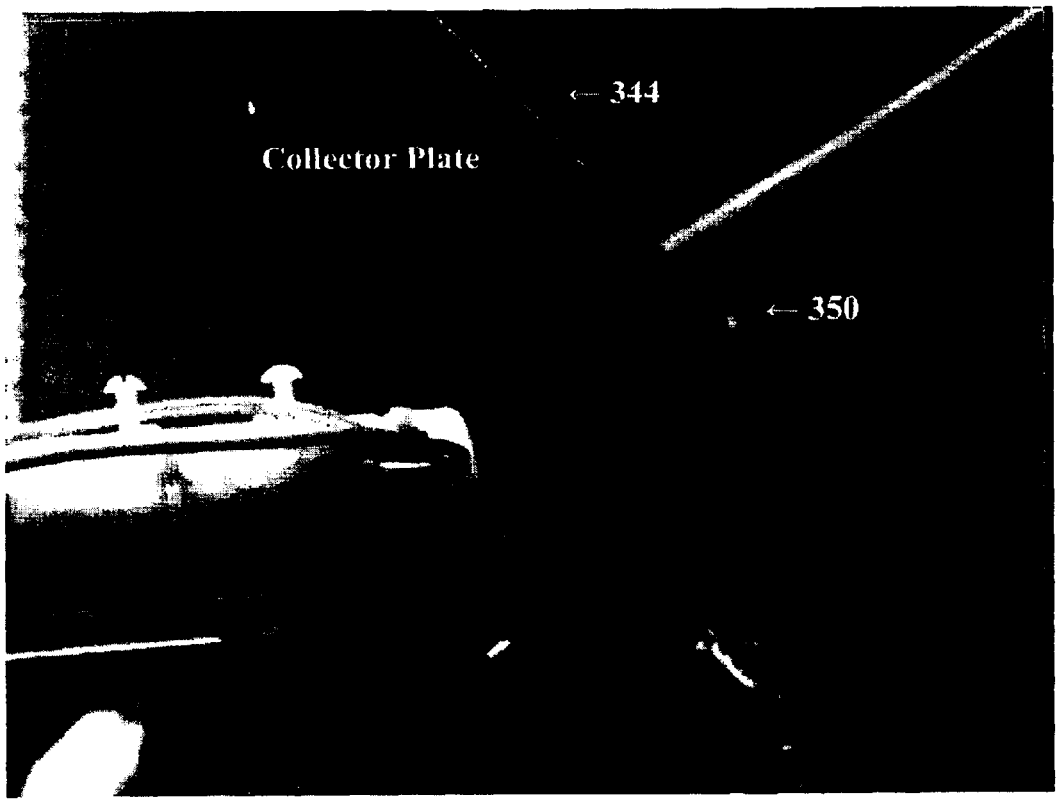
FIG. 11 is a front elevational view of a charging device and collector in accordance with another embodiment of the invention.
Figure 12:
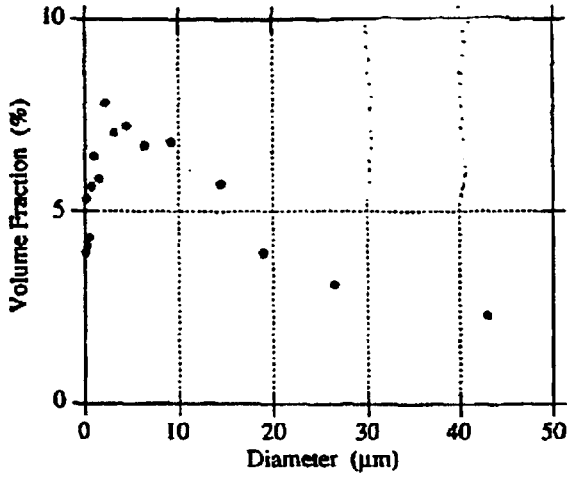
FIG. 12 is a graph of the size distribution of a sample of particles separated using an apparatus in accordance with the embodiment of FIG. 10.
Figure 13:
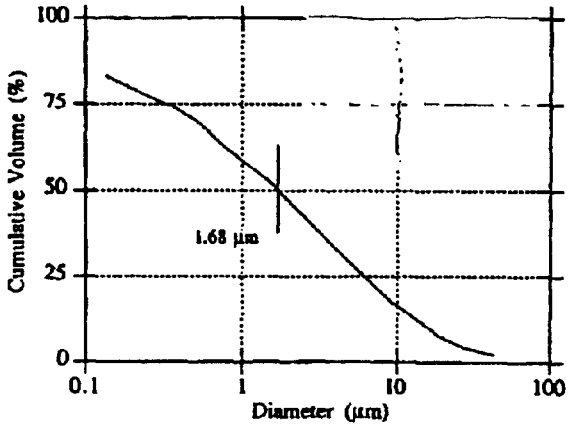
FIG. 13 is a graph of the volume percent of particles in excess of a given size, for the particles of FIG. 12.

As shown in FIGS. 12 and 13, the particle size distribution achieved using the plate shown in FIG. 10 has a structured peak with an absolute maximum value of 7.36% at 2.60 μm. After separation, 42% of the particles are 1 μm or less as compared to 20% for the control sample. The small particle population of the collected particles, compared to the original particles, was significantly enhanced. The larger particles were separated out as well, but less dramatically than by the factor of two noted for the small particle moiety. The proportion of particulates larger than 10 μm was reduced from about from 19.1% to 16.0%, about a one sixth reduction.

The collector may have any shape. In a further example, a 38 mm high copper plate was bent at 90° with the fold positioned on the centerline of the charging device and 8 mm from the window of the charging device. The downstream portion of the plate was 65 mm and angled to be parallel with the aerosol stream emanating from the nozzle of the charging device, which was 6.5 mm upstream of the fold. Particles deposited on the 28 mm portion of the plate, oriented perpendicular to the aerosol stream centerline, represented the most highly charged and vigorously dispersive particulates in the stream. These particulates obtained sufficient charge to be dispersed perpendicularly to a stream having a mean velocity somewhat in excess of 6 m/s and to coat the plate surface out to its furthest extent of 28 mm from the stream edge.

Figure 14:
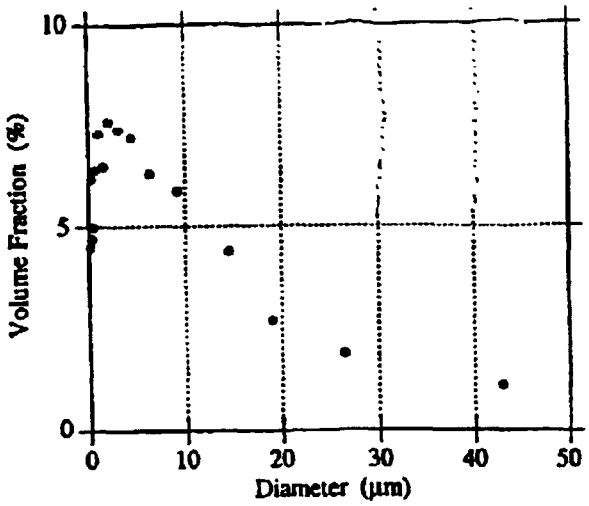
FIG. 14 is a graph of the size distribution of a sample of particles separated using an apparatus in accordance with a further embodiment of the invention.
Figure 15:
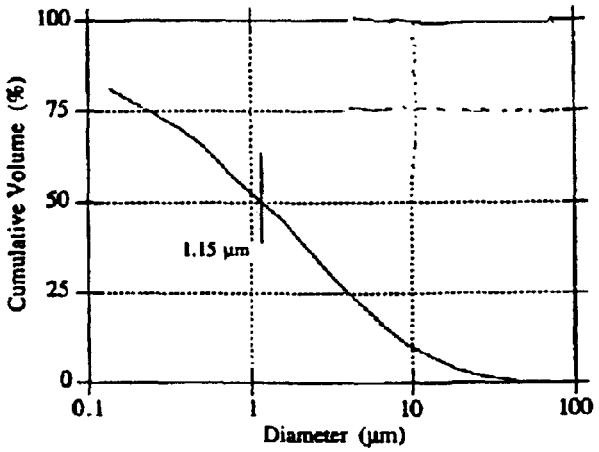
FIG. 15 is a graph of the volume percent of particles in excess of a given size, for the particles of FIG. 14.

The size distribution of the particles, (shown in FIG. 14) was strongly shifted toward the small size end of the spectrum with a peak at 2.6 μm. These particles had a Vso size that is less than a third of the unseparated powder (1.15 μm compared to 3.73 μm), with fully 47.3% of the distribution mass comprised of particulates smaller than one micron (See FIG. 15). 10.1% of the distribution was larger than ten microns, implying that some of the larger particulates were also strongly charged. Embodiments of the present invention can be used for separation of particles of any size. It should be noted that the examples discussed above represent collection surfaces that were limited in size and these examples should not be taken as a limitation on the true separation capability of the process.

Embodiments of the present invention achieve size separation of pharmaceutical powders, and any particles, by directly charge injecting a stream of particles. Useful flow rates of about a gram per second, or more can be achieved. Modest charging currents of the order of one microampere and input electrical power (fractions of a watt) are adequate to produce spatial separation of particles within distances of the order of ten centimeters. Self-field auto-dispersion of charge injected particle streams, unaugmented by exterior fields, is achieved utilizing embodiments of the present invention.

Embodiments of the present invention include separating, filtering and/or sorting particles by properties other than the size of the particles. A plurality of particles having different capabilities to accept charge, due to size, type of particle, or any other characteristic, can be sorted, filtered, or separated by that characteristic. For example, a plurality of particles of different materials may be sorted by type of material.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. An apparatus for separating a stream of particles by size, comprising:

a) a charging device for injecting a net charge into a plurality of particles to thereby provide a plurality of charged particles; and b) a collector adjacent the charging device, said collector and said charging device arranged so that the charged particles disperse solely under the influence of a self-field created by the charged particles and mutual repulsion between the charged particles, in the absence of an externally-applied electric field and collect on the collector according to size.

2. The apparatus of claim 1, further comprising a feed apparatus arranged for delivering a stream of particles to the charging device.

3. The apparatus of claim 2, wherein the feed apparatus is selected from the group consisting of: an aerosol feed apparatus; and a vibratory feed apparatus.

4. The apparatus of claim 3, wherein the feed apparatus entrains the particles in a moving fluid.

5. The apparatus of claim 2, wherein the feed apparatus is disposed upstream of the charging device and moves a fluid entrained with the particles in a downstream direction.

6. The apparatus of claim 5, wherein the charging device comprises an electron gun.

7. The apparatus of claim 6, wherein the collector is disposed downstream of the charging device.

8. The apparatus of claim 7, wherein the collector comprises a body of a conductive material.

9. The apparatus of claim 8, wherein the collector comprises a body selected from the group consisting of: a collector cone; a collector plate; and at least one collector container.

10. An apparatus for separating a stream of particles by size, comprising:

a) a charging device for injecting a net charge into a plurality of particles; and b) a collector adjacent the charging device, the collector being grounded and arranged so that the charged particles disperse and collect on the collector according to size; and (c) a feed apparatus arranged for delivering a stream of particles to the charging device wherein the feed apparatus is disposed upstream of the charging device and moves a fluid entrained with the particles in a downstream direction;

wherein the charging device comprises an electron gun;

wherein the collector is disposed downstream of the charging device; and wherein the collector comprises a body of a conductive material, said body of conductive material including a collector plate bent at a fold line.

11. A method of separating a stream of particles by size, comprising:

a) injecting a net charge to a plurality of particles including particles having different sizes so that each particle has a charge to mass ratio depending upon the size of the particle, whereby said charged particles create a self-field and mutually repel one another; and b) allowing the charged particles to disperse solely under the influence of said self-field and said mutual repulsion, in the absence of an externally-applied electric field and collect on a collector having a conductive surface.

12. The method of claim 11, wherein the charge is injected by directing free electrons at the plurality of particles.

13. The method of claim 11, further comprising a step of providing the plurality of particles by entraining the plurality of particles in a fluid.

14. The method of claim 13, wherein the step of providing includes moving the fluid so as to generate a stream of the particles moving in a downstream direction.

15. The method of claim 14, wherein the stream of particles is directed at a charging device and the collector is disposed downstream of the charging device.

16. The method of claim 15, wherein the step of allowing the charged particles to disperse includes moving the fluid, after the particles are injected with the net charge, until the particles are significantly arranged according to size.

17. The method of claim 12, wherein allowing the particles to collect includes depositing the first particle in a first region of the collector and depositing the second particle in a second region of the collector.

18. The method of claim 11, wherein the charge is injected by directing a stream of the particles past a pair of electrodes located upstream of an orifice.

* * * * *